US006533432B1

(12) United States Patent
Alender

(10) Patent No.: US 6,533,432 B1
(45) Date of Patent: Mar. 18, 2003

(54) SCREWDRIVER

(75) Inventor: Wolfgang Josef Alender, Aalen (DE)

(73) Assignee: Cooper Power Tools GmbH & Co., West Hausen (DE)

( * ) Notice: Subject to any disclaimer, the term of this patent is extended or adjusted under 35 U.S.C. 154(b) by 8 days.

(21) Appl. No.: 09/610,759

(22) Filed: Jul. 6, 2000

(30) Foreign Application Priority Data

Jul. 7, 1999 (DE) ..... 299 11 786 U

(51) Int. Cl.[7] ..... B25B 17/00; B25B 23/18
(52) U.S. Cl. ..... 362/119; 362/120; 362/109
(58) Field of Search ..... 362/578, 119, 362/391, 457, 89, 109, 120, 183; 81/483, 54; 30/500; 439/866

(56) References Cited

U.S. PATENT DOCUMENTS 4,283,757 A * 8/1981 Nalbandian et al. ..... 362/120
6,095,658 A * 8/2000 Klaousis ..... 362/119
6,168,287 B1 * 1/2001 Liu ..... 362/119

* cited by examiner

*Primary Examiner*—Sandra O'Shea
*Assistant Examiner*—Anabel Ton
(74) *Attorney, Agent, or Firm*—Coats & Bennett, P.L.L.C.

(57) ABSTRACT

A screwdriver comprises at least one housing and a rotatably driven screw-tightening tool projecting beyond said housing. For improving the screwdriver in such a way that, even under poor illumination conditions, it can be used safely and accurately without any additional expenditure of work on the part of the user, an illumination means is arranged at least partially on the housing especially for illumination in the direction of the location of use of the screw-tightening tool.

14 Claims, 1 Drawing Sheet

SCREWDRIVER

The present invention relates to a screwdriver comprising a housing and a rotatably driven screw-tightening tool projecting beyond said housing.

Such screwdrivers are known in practice e.g. for mounting motor vehicles or the like. In certain situations, the screwdriver is used by a user at locations which are not easily accessible and poorly illuminated. This will make it more difficult to align the screw-tightening tool to the respective location of use e.g., for tightening a screw or the like, since, due to the poor illumination conditions, the user may perhaps only be able to identify the location of use by touch and align the screw-tightening tool subsequently.

Hence, it is the object of the present invention to improve a screwdriver of the type mentioned at the beginning in such a way that, even under poor illumination conditions, it can be used safely and accurately without any additional expenditure of work on the part of the user.

According to the present invention, this object is achieved by an illumination means arranged at least partially on the housing especially for illumination in the direction of the location of use of the screw-tightening tool. The illumination means can in this way be moved together with the screwdriver without any necessity of using a separate illumination means which has to be held e.g. by a helper or put down at the location in question for illuminating the location of use. The illumination means can illuminate directly or indirectly. When the illumination means is comparatively small and compact, an illumination directly in the direction of the location of use may of advantage.

Such a location of use of the screwdriver is e.g., a screw-tightening location at which a screw has to be tightened e.g., for securing the pedal/steering gear in position in the foot area of a motor vehicle. Additional locations of use of this kind are apparent. At this point, it should be noted that, although the illumination means according the present invention is here described in connection with a screwdriver, it can be also used in an analogous fashion for other tools used at poorly illuminated locations, such a drills, soldering means or the like.

To be able to take along a complete illumination means, said illumination means may comprise a voltage supply unit and an illumination unit connected to said voltage supply unit via electric connection lines. The voltage supply unit can be arranged separately from the screwdriver and it can be connected e.g. to a low-voltage supply in the usual way. The illumination means arranged on the screwdriver is supplied via the electric connection lines. The electric connection lines can, for this purpose, be guided to the illumination means along the respective connection lines of the screwdriver and along the screwdriver itself.

An advantageous further development of the illumination means can be seen in the circumstance that also the voltage supply unit is releasably secured to the screwdriver and especially to the housing of said screwdriver. The screwdriver and the illumination means define a unit in this way and it will suffice to supply them with power from outside.

To be able to dispense with a separate power supply of the voltage supply unit of the illumination means, the voltage supply unit can be adapted to be electrically connected to a screwdriver voltage supply arranged in the housing of the screwdriver. In this case, it will also be possible that the voltage supply unit of the illumination means is defined directly by the screwdriver voltage supply so that suitable electric connection lines will only extend from the screwdriver voltage supply to the illumination means.

For permitting the screwdriver to be used without the illumination means, if desired, the voltage supply unit of the illumination means can be adapted to be released and to be pushed onto the housing of the screwdriver, for example; the electric connection between the voltage supply unit and the screwdriver voltage supply can be established by this pushing on or in some other known way.

For permitting the electric connection lines to be safely guided between the voltage supply unit and the illumination unit, said connection lines can be arranged in a tube extending along the screwdriver.

Depending on the field of use and the kind of screwdriver, the tube can be implemented as a fixed, a flexible and/or a telescoping tube. A telescoping tube will be advantageous especially in cases where e.g. different screw-tightening tools are used at different distances from the housing of the screwdriver. Due to the variable length of the tube, the illumination unit can in this way always be arranged as closely as possible to the screw-tightening tool so that the location of use will be well illuminated.

For providing a comparatively good protection of the illumination unit when the screwdriver is in use, the illumination unit may comprise an illuminator housing containing an illuminant. The illuminant is protected against shocks and, consequently, damage by means of the illuminator housing. In addition, the illuminator housing may be equipped with one or a plurality of reflectors which permit a better utilization of the illuminant for illuminating the location of use. Furthermore, the illuminator housing can prevent the user from being dazzled by the illuminant. The illuminator housing also has the function of centering an optional screw-driving-tool extension.

When the screwdriver in question is implemented as an angular screwdriver, it is imaginable that the illuminator housing is releasably secured to the angular gear of said angular screwdriver. In the case of such an angular screwdriver, the angular gear normally extends at right angles to the actual housing of the screwdriver so that also the electric connection lines and the tube containing these connection lines extend at right angles between the housing and the angular gear in an advantageous manner so that they are arranged as closely to the screwdriver as possible and so that as little space as possible is required.

For providing angular gears having different lengths and, if desired, also different thicknesses with the respective illuminator housing for different cases of use of the screwdriver, the illuminator housing can be adapted to be clamped to the angular gear. The clamping can be effected by means of a suitable clamp which is implemented such that it is variable in position as well as adaptable to different thicknesses of the angular gear. Different lengths of the tool extension can additionally be compensated for by the telescopic nature or the flexibility of the tube containing the connection line.

A comparatively economically priced and sufficiently bright illumination is e.g., given when said illuminant is defined by at least one light-emitting diode (LED). According to requirements, it is, of course, possible to provide a plurality of these LEDs. Such LEDs can be arranged on one side of the angular gear as well as around the angular gear, the illuminator housing being arranged and implemented accordingly.

LEDs which generate only little heat, consume little energy and have a shock resistance that is sufficient for industrial applications are the so-called cold-light LEDs. A suitable number of these cold-light LEDs can be contained in the illuminator housing in an appropriate arrangement.

The illuminator housing can be displaceably and/or adjustably secured to the angular gear so that, if necessary, said illuminator housing can be arranged at different positions relative to the location of use or so that also a location adjacent the location of use can be illuminated.

The handling of the screwdriver together with the illumination means can be simplified in an advantageous manner when the illumination means is provided with a switching electronics for switching the illuminant automatically on and off. The illuminant is, for example, switched on when the screwdriver is started, and it is automatically switched off after deactuation of the screwdriver.

Since in the case of many screw-tightening operations the screwdriver is re-used after each deactuation within a comparatively short period of time, it is also imaginable that the switching electronics is provided with a switch-off element for delayed switching off of the illuminant when the screwdriver is no longer in use. This has the effect that the illuminant is not directly switched off synchronously with the deactuation of the screwdriver, but only after a pre-set overrun time of e.g., three minutes or the like. If the screwdriver is then re-used within this overrun time, the illuminant will still be active and need not be reactivated manually or automatically. It is in this way also guaranteed that the illuminant will be switched off automatically at the end of a shift or on completion of the work, even if the screwdriver itself is not separated from its voltage supply.

It is also possible to retrofit screwdrivers or the like which are already in use with the illumination means according to the present invention and, depending on the structural design of the screwdriver, the illumination means can be provided with a voltage supply which is independent of the screwdriver or with the above-described voltage supply which his adapted to be coupled to the voltage supply of the screwdriver. Such a retrofit kit for the illumination means is also the subject matter of the present application.

In the following, an advantageous embodiment of the present invention will be explained in detail making reference to the figures in the enclosed drawing, in which

DETAILED DESCRIPTION OF THE PREFERRED EMBODIMENTS

Figures 1, 2:
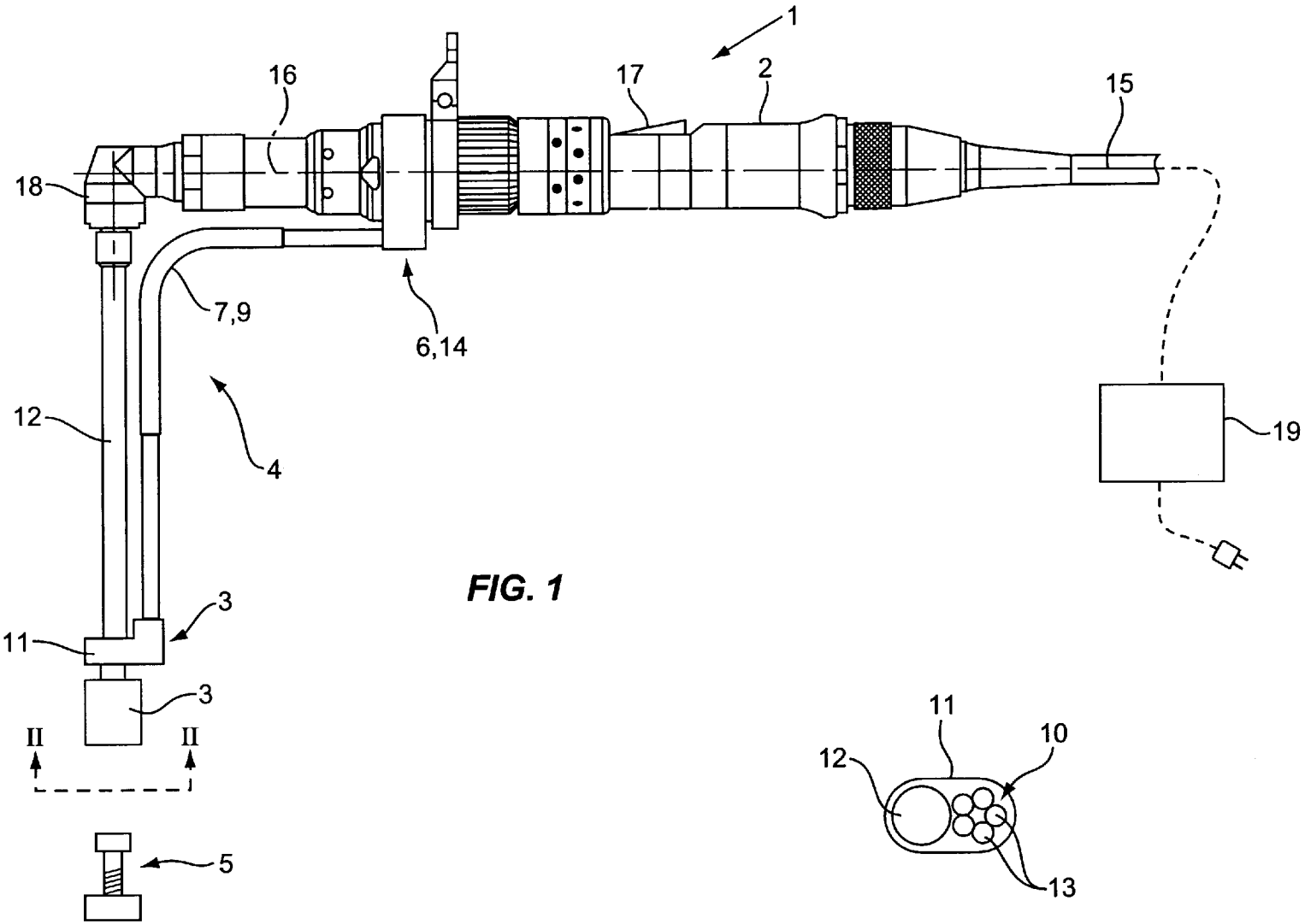
FIG. 1 shows a side view of a screwdriver provided with an illumination means according to the present invention.
FIG. 2 shows a view of the screwdriver according to FIG. 1 seen in the direction of sight II.

FIG. 1 shows a side view of a power-operated screwdriver 1. This screwdriver 1 is implemented as an angular screwdriver comprising a housing 2 extending along a longitudinal direction 16 and a total extension 12 extending at right angles to said housing 2 via angular gear 18. At the end located opposite the tool extension 12, a partially shown supply line 15 extends from the housing 2, said supply line 15 being used for the power supply 19 of the screwdriver 1.

The screwdriver 1 has arranged thereon an illumination means 4. This illumination means 4 comprises a voltage supply unit 6 and an illumination unit 8. The voltage supply unit 6 is releasably fastened to the housing 2 e.g., by pushing on. Furthermore, the voltage supply unit 6 is in electric contact with a voltage supply of the screwdriver 1, arranged in the housing 2. Separate supply lines 15 for the illumination means 4 are therefore not necessary. The illumination unit 8 is connected to the voltage supply unit 6 via electric connection lines 7 arranged in a tube 9. The tube 9 extends first from the voltage supply unit 6 parallel to the longitudinal axis 16 and then parallel to the tool extension 12. The tube 9 can.be implemented as a fixed tube, extending along a predetermined path between the voltage supply unit 6 and the illumination unit 8. The tube 9 can also be implemented as a flexible and/or telescoping tube so as to adapt it to different angular positions between the tool extension 12 and the housing 2 or different lengths of the tool extension 12.

The illumination unit 8 comprises an illuminator housing 11 which is located adjacent the screw-tightening tool 3 at the free end of the tool extension 12 and which is used for centering the tool extension 12. The screw-tightening tool 3 is secured to the tool extension 12 or the housing 2 of the screwdriver 1 such that it projects beyond them and it is adapted to be assigned to a location of use 5 for carrying out the screw-tightening operation. The illuminator housing 11 is arranged in such a way that the location of use 5 will be illuminated when the screw-tightening tool 3 is moved to a point close to said location of use.

FIG. 2 shows a front view of the illuminator housing 11 which screw-tightening tool 3 has been omitted to simplify matters.

The illuminator housing 11 has arranged therein an illuminant 10 in the form of a plurality of LEDs (light-emitting diodes) 13. In the embodiment shown, five LEDs are arranged in a star-shaped configuration adjacent the screw-tightening tool 3 in the illuminator housing 11.

The LEDs can be so-called cold-light LEDs which are characterized by little heat generation and a low energy consumption as well as by a comparatively high shock resistance.

The voltage supply unit 6 can additionally have arranged therein a switching electronics 14 for the illumination means 4. This switching electronics 14 serves to switch the illuminant 10 automatically on and/or off, when the screwdriver 1 is switched on or off. The switching electronics 14 includes a switch-off element for delayed switching-off of the illuminant 10 so that the power supply to said illuminant 10 will be continued for a pre-set period of time when the screwdriver 1 has been switched off.

According to the present invention, the illuminating means 4 can also be arranged on the screwdriver 1 as a retrofit kit; in this case, the voltage supply unit 6 is adapted to be connected to a voltage supply, which is not shown, via separate supply lines analogously to the supply lines 15. It should be pointed out that also in the case of such a retrofit kit for the illuminating means 4 according to the present invention an electric connection between the voltage supply unit 6 are one voltage supply supplying the screwdriver 1 and arranged in the housing 2 is possible, provided that the screwdriver has a suitable structural design.

In the case of a retrofit kit for the illuminating means 4, a separate switch can be arranged e.g. on the voltage supply unit 6, by means of which the illuminant 10 can be switched on and off.

What is claimed is:

1. A screwdriver comprising:

a) at least one housing;

b) a rotatably driven screw-tightening tool coupled to, and projecting beyond said housing;

c) an illumination means arranged at least partially on said housing, said illumination means adapted to provide illumination in the direction of the location of use of said screw-tightening tool when said screw-tightening, tool is proximate said location of use, said illumination means comprising:

i) a voltage supply unit;

ii) at least one electrical connection line;

iii) an illumination unit connected to said voltage supply unit via said electrical connection line;

d) wherein said illumination unit comprises an illuminator housing containing an illuminant; and e) wherein said screwdriver is an angular screwdriver and further including an extension extending between said housing and said screw-tightening tool, wherein said illuminator housing aids in centering said extension.

2. The screwdriver of claim 5 wherein said voltage supply unit releasably secures to said housing.

3. The screwdriver of claim 5 further comprising a screwdriver voltage supply disposed in said housing; and wherein said voltage supply unit of said illumination means electrically connects to said screwdriver voltage supply.

4. The screwdriver of claim 3 wherein said voltage supply unit of said illumination means is adapted to be pushed into said housing.

5. A screwdriver comprising:

a) at least one housing;

b) a rotatably driven screw-tightening tool coupled to, and projecting beyond said housing; and c) an illumination means arranged at least partially on said housing, said illumination means adapted to provide illumination in the direction of the location of use of said screw-tightening tool when said screw-tightening tool is proximate said location of use, said illumination means comprising:

i) a voltage supply unit;

ii) at least one electrical connection line;

iii) an illumination unit connected to said voltage supply unit via said electrical connection line;

iv) a telescoping tube extending along a portion of said screwdriver and at least partially surrounding said connection line.

6. The screwdriver of claim 5 wherein said tube is relatively inflexible.

7. The screwdriver of claim 5 wherein said tube is flexible.

8. The screwdriver of claim 5 wherein said illuminant comprises at least one light-emitting diode.

9. The screwdriver of claim 8 wherein said illuminant comprises a plurality of cold-light light-emitting diodes arranged side by side.

10. A screwdriver comprising:

a) at least one housing;

b) a rotatably driven screw-tightening tool coupled to, and projecting beyond said housing;

c) an illumination means arranged at least partially on said housing, said illumination means adapted to provide illumination in the direction of the location of use of said screw-tightening tool when said screw-tightening tool is proximate said location of use, said illumination means comprising:

i) a voltage supply unit;

ii) at least one electrical connection line;

iii) an illumination unit connected to said voltage supply unit via said electrical connection line;

d) wherein said illumination unit comprises an illuminator housing containing an illuminant; and e) wherein said illumination means further includes a tube extending along a portion of said screwdriver and at least partially surrounding said connection line and wherein said illumination unit comprises an illuminator housing containing an illuminant and wherein said illumination unit adjustably secures to said tube.

11. The screwdriver of claim 5 further including a starting lever coupled to said housing operative to turn on and off power to said screw-tightening tool and wherein said starting lever further controls turning on said illumination means.

12. The screwdriver of claim 5 wherein said illumination means further comprises switching electronics controlling the operation of said illuminant.

13. The screwdriver of claim 12 wherein said switching electronics delays turning off said illuminant in response to deactivation of said screw-tightening tool.

14. The screwdriver of claim 1 wherein said extension includes an angular gear and wherein said illuminator housing clamps to said angular gear.

* * * * *